United States Patent [19]

Collins

[11] 4,448,096

[45] May 15, 1984

[54] FLUTTER LIFT FOR TORQUE WRENCH

[76] Inventor: Bobby W. Collins, P.O. Box 1366, Harvey, La. 70059

[21] Appl. No.: 317,325

[22] Filed: Nov. 2, 1981

Related U.S. Application Data

[63] Continuation-in-part of Ser. No. 218,663, Dec. 22, 1980, abandoned.

[51] Int. Cl.[3] ..... B25B 13/46

[52] U.S. Cl. ..... 81/57.39

[58] Field of Search ..... 81/57.39; 74/128

[56] References Cited

U.S. PATENT DOCUMENTS 2,712,256 7/1955 Fish ..... 81/57.39

4,027,561 6/1977 Junkers ..... 81/57.39

*Primary Examiner*—James L. Jones, Jr.

*Attorney, Agent, or Firm*—Roy & Kiesel

[57] ABSTRACT

An improved torque wrench having a ratcheting assembly provided with a locking pawl activated flutter lift for disengaging a torque wrench racheting pawl during the return stroke of hydraulic cylinder piston arm.

2 Claims, 6 Drawing Figures

FLUTTER LIFT FOR TORQUE WRENCH

RELATED APPLICATIONS

This is a continuation-in-part application of U.S. patent application Ser. No. 06/218,663 filed Dec. 22, 1980, now abandoned, by the inventor herein and entitled "Hydraulic Torque Wrenches," specific mention thereof being made for the purpose of obtaining benefit of its earlier filing date.

BACKGROUND OF THE INVENTION

1. Field of the Invention. This invention relates to hydraulic torque wrenches, and more particularly to a flutter lift for disengaging a ratcheting pawl from a ratcheting gear during the return stroke of the hydraulic cylinder piston arm.

2. Prior Art. There is need for development of a hydraulic torque wrench which can withstand the large torquing forces necessary to loosen in-field bolts utilized on heavy industrial equipment.

Examples of the present state of the art can be seen in the following patents:

| U.S. Pat. No. | Inventor | Issued | Title |
|---|---|---|---|
| 3683686 | Sergan | 8/15/72 | "Mechanical Torque Wrench and a Hydraulic Readout Therefor" |
| 3745858 | Birch | 7/17/73 | "Torquing Device" |
| 3930776 | Keller | 1/06/76 | "Hydraulic Wrench" |
| 3995828 | Orban | 12/07/76 | "Bolt Tensioning Device" |
| 4027561 | Jenkins | 6/07/77 | "Hydraulic Wrench |
| 4060137 | Bickford, et al | 12/29/77 | "Torque Wrench" |
| 4091890 | Wilmith, et al | 5/30/78 | "Very High Torque Ratchet Wrench" |

Despite the prior art, there exists a continued need for hydraulic torque wrenches that more conveniently attach and operate in the field on equipment with less wear and tear. Also needed are torque wrenches which can more rapidly loosen and remove nuts from flange bolts. A particular problem with present hydraulic torque wrenches has been the breaking of ratchet gear teeth resulting from incomplete disengagement during the return stroke of the hydraulic piston arm. These problems are particularly acute in the petro-chemical industry and even more so on offshore drilling and pumping equipment where time saving means large savings in operating costs.

SUMMARY OF THE INVENTION

Therefore, it is an object of this invention to provide a hydraulic torque wrench that can conveniently attach and operate in the field on equipment with less wear and tear.

Another object of this invention is to provide a hydraulic torque wrench that can more rapidly loosen and remove nuts from flange bolts.

Still another object of this invention is to provide a hydraulic torque wrench that minimizes or eliminates the breaking of ratchet gear teeth during the disengagement of the rachet pawl during the return stroke of the hydraulic cylinder piston arm.

Other objects and advantages of this invention will become apparent from the ensuing descriptions of the invention.

Accordingly, a hydraulic torque wrench having a ratcheting assembly comprising a ratcheting gear having gear teeth, wherein the ratcheting gear is rotatably attached to a body assembly plate, a drive pawl attached at one end to a hydraulic cylinder piston rod and driving by engageable at its opposite end to the ratcheting gear, the improvement to which comprises a rachet pawl lifting assembly pivotly attached to the body assembly plate having a lifting arm and extending to the drive pawl a distance sufficient for the drive pawl to clear the gear teeth, and means for activating the lifting arm to raise the drive pawl to clear the gear teeth during the return stroke of the piston rod.

PREFERRED EMBODIMENTS OF THE INVENTION

Figure 1:
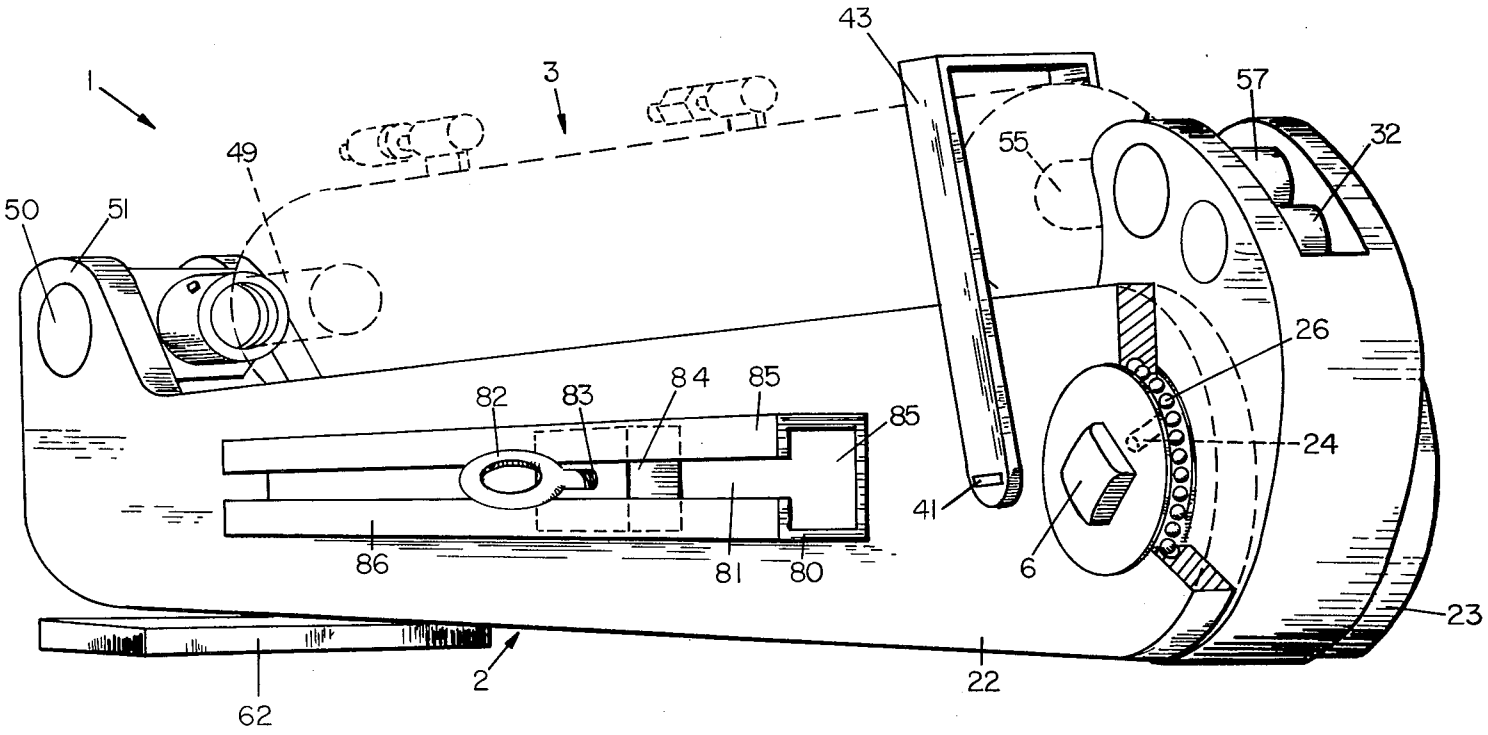
FIG. 1 is a cutaway three dimensional view of a preferred embodiment of the hydraulic torque wrench of this invention.

The hydraulic torque wrench comprises in general a ratcheting assembly, denoted generally by the numeral 1, a body assembly, denoted by the numeral 2, and a hydraulic cylinder 3. More particularly, the ratcheting assembly comprises a ratcheting gear 4, having gear teeth 5, which ratcheting gear 4 is mounted on a drive plate or axle 6, which is fixedly attached by threaded screws 7, which are screwed through threaded openings 8 of ratcheting gear 4 and into aligned slots 9 of axle 6. In a preferred embodiment, axle 6 will have a square or rectangular cross section and be of sufficient length to extend outward from both ends 10 of ratcheting gear 4 and body plates 22 and 23, as shown in the Figures. A pair of parallel drive plates 11 provided with openings 12, through which axle 6 may pass, is rotatably positioned to ratchet gear shoulder member 13. At each end of the axle are bushings 16 and 17, where, in a preferred embodiment, each bushing 16 and 17 is provided with a ball bearing asembly 18 and 19, respectively. Each of the bushings 16 and 17 are shaped to rotatably engage with openings 20 and 21, respectively, in body plates 22 and 23, respectively. Bushings 16 and 17 are secured to axle shoulder member 13 by threaded bolts 14 which screw into matingly threaded openings 15 of bushings 16 and 17 and threaded openings **15*a*. In a preferred embodiment, bushings 16 and 17 are provided with ball bearing loading channels 24 and 25, respectively, through which ball bearings 26 can be channeled into grooves 27 and 28 of openings 20 and 21, respectively, once bushings 16 and 17 are positioned in openings 20 and 21, respectively. Ball bearing loading channels 24 and 25 can be sealed by threaded screws 40 that is screwed into loading channels 24 and 25. Ratcheting assembly 1 also comprises a drive pawl 29, having drive arm 30 mounted on extension member 31 perpendicularly attached to drive pawl axle 32, which extends through a second pair of aligned openings 33 and 24 of drive plates 10 and 11, respectively, as shown in the Figures. In a preferred embodiment, drive pawl teeth 30 form an angle of approximately 57.5° for superior mating with adjacent gear teeth 5, which form an angle preferably of 90°. Also, as part of ratcheting assembly 1, a gear locking pawl 35 is fixedly mounted on a gear locking pawl pin 36 by threaded screw 37 screwed through threaded opening 38 of pawl 35 and into threaded opening 39 of pawl pin 36. Locking pawl 35 is also provided with a pawl arm 35A for engaging gear teeth 5 in a manner which, when engaged with gear teeth 5, prohibit rotation of gear 5 in the direction of locking pawl 35. Pawl pin 36 entends through a pair of alinged openings 88 located in body plates 22 and 23, respectively. Each end of pawl pin 36 is provided with a rectangularly shaped stud 41 to which is attached locking pawl lift handle 42, having plate member 43 extending over the top edge 44 of body plates 22 and 23 and provided with downwardly extending plate extensions 45 and 46, each provided with mating rectangular openings 47 and 48, respectively, to allow pawl pin studs 41 to extends therethrough. In this manner, locking pawl arm 35A can be engaged and disengaged from gear teeth 5 by the rotation of locking pawl lift handle 42**.

In another preferred embodiment, a drive pawl lift pin assembly 71 comprises a L-shaped bar piece 72 attached to mid-rib dividers 61 with threaded opening 73 located in the shorter member 74 and through which threaded bolt 75 is screwed. Bolt 75 protrudes over ratcheting gear 4 a sufficient distance to contact extension member 31 when piston rod 55 is fully retracted and holds extension member 31 so drive teeth 30 are not engaged with rachet gear teeth 5. Thus, in this position axle 6 can be rotated freely to properly align with the nut or bolt to be worked on.

Figure 3:
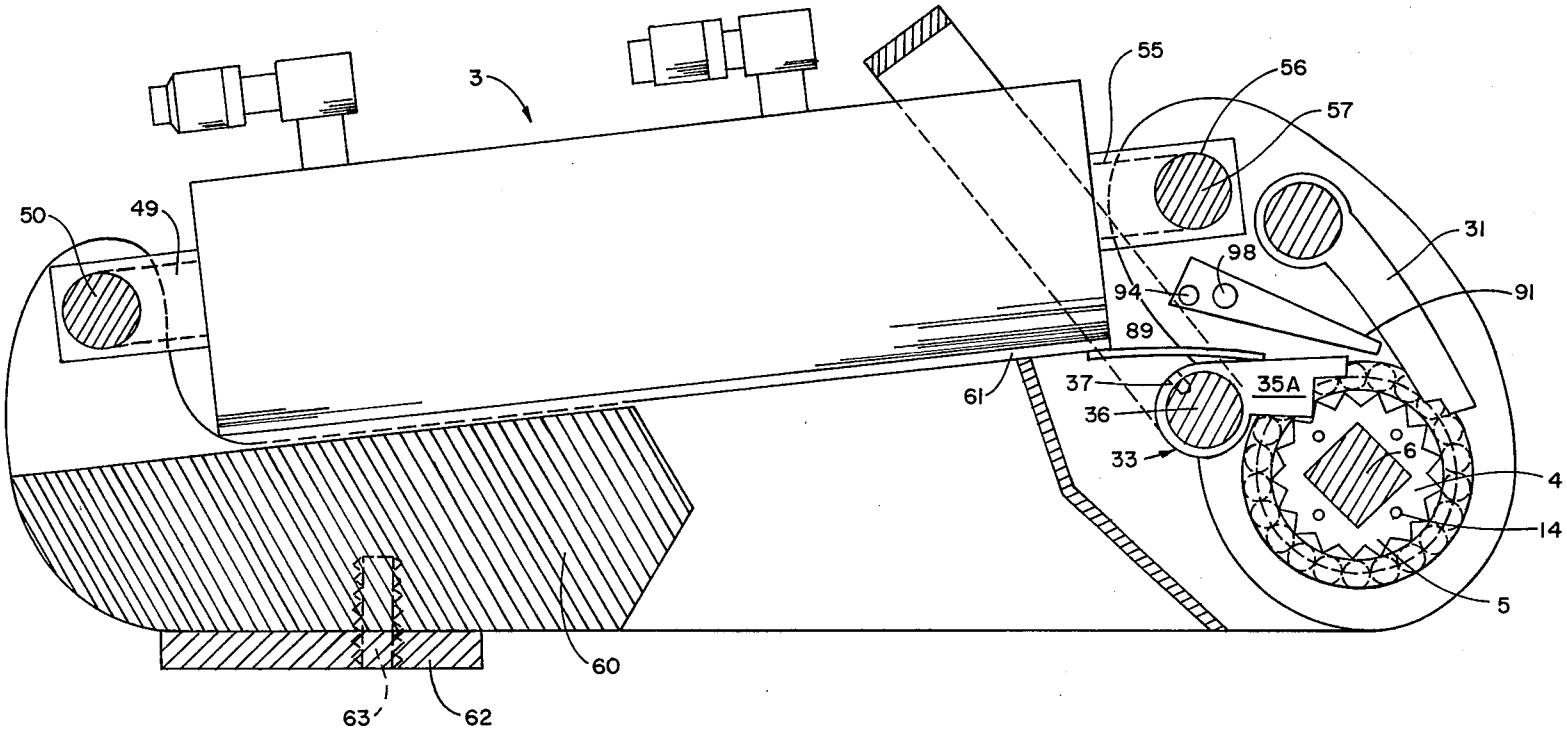
FIG. 3 is a cutaway view of a preferred embodiment of the gear, automatic pawl lift and locking pawl assembly.
Figure 4:
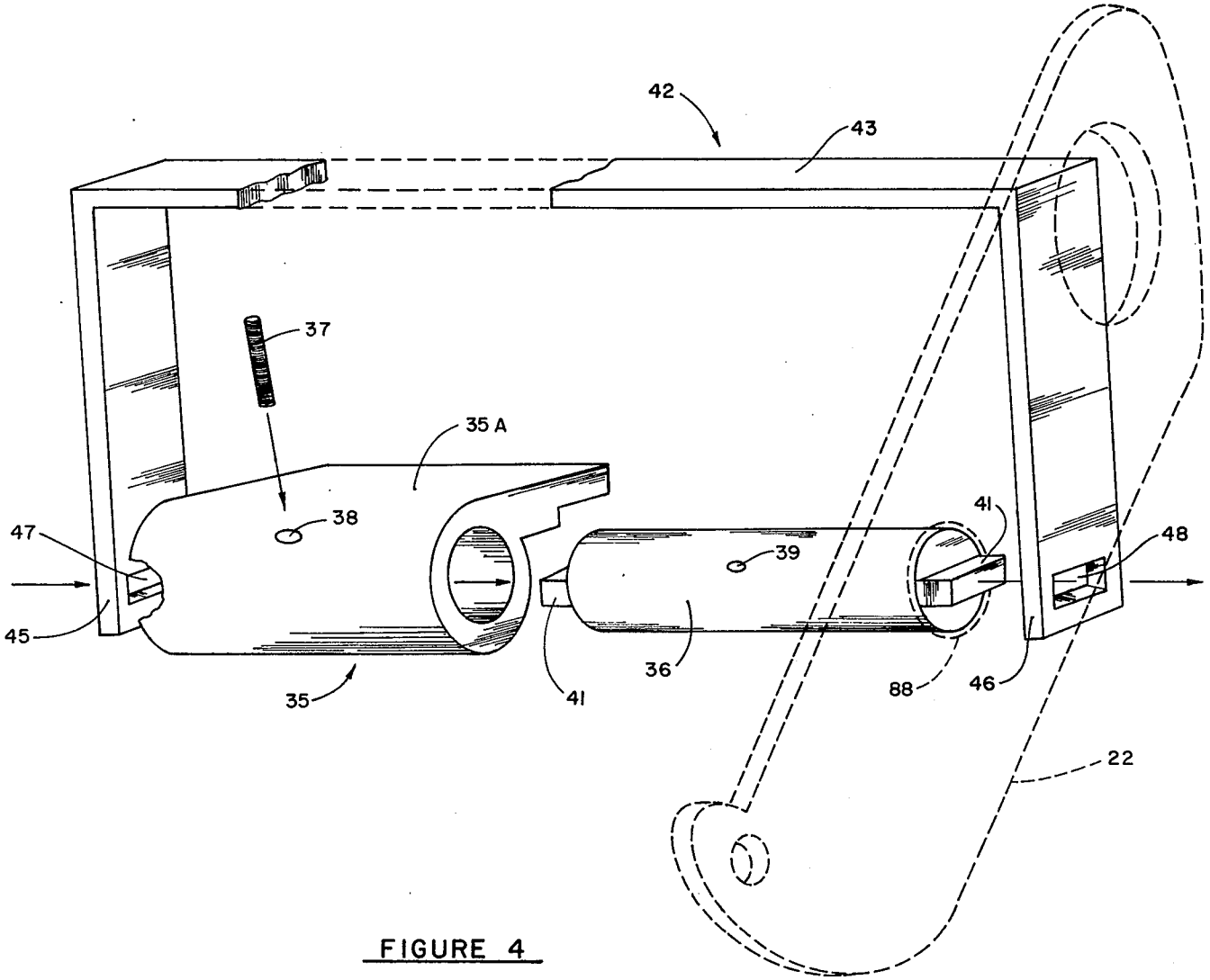
FIG. 4 is an exploded view of the gear locking pawl assembly.

In a more preferred alternate embodiment as shown in FIG. 3 leaf spring 89 is attached to mid-rib divider 61 and bent to apply a downward pressure on locking pawl arm 35A to engage it in gear teeth 5 as shown.

Figure 5:
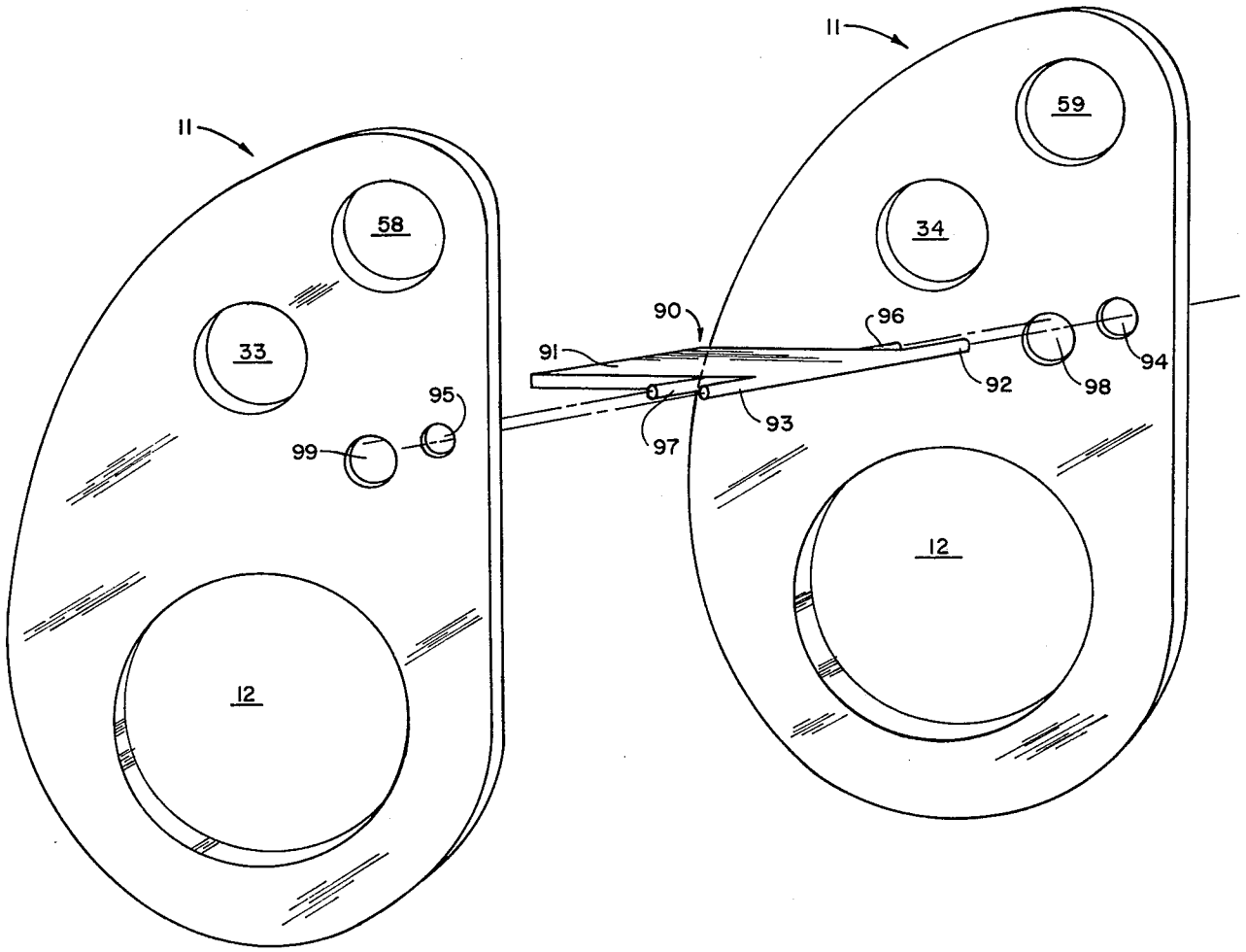
FIG. 5 is a cutaway view of an alternate preferred embodiment of the flutter lift of this invention.
Figure 6:
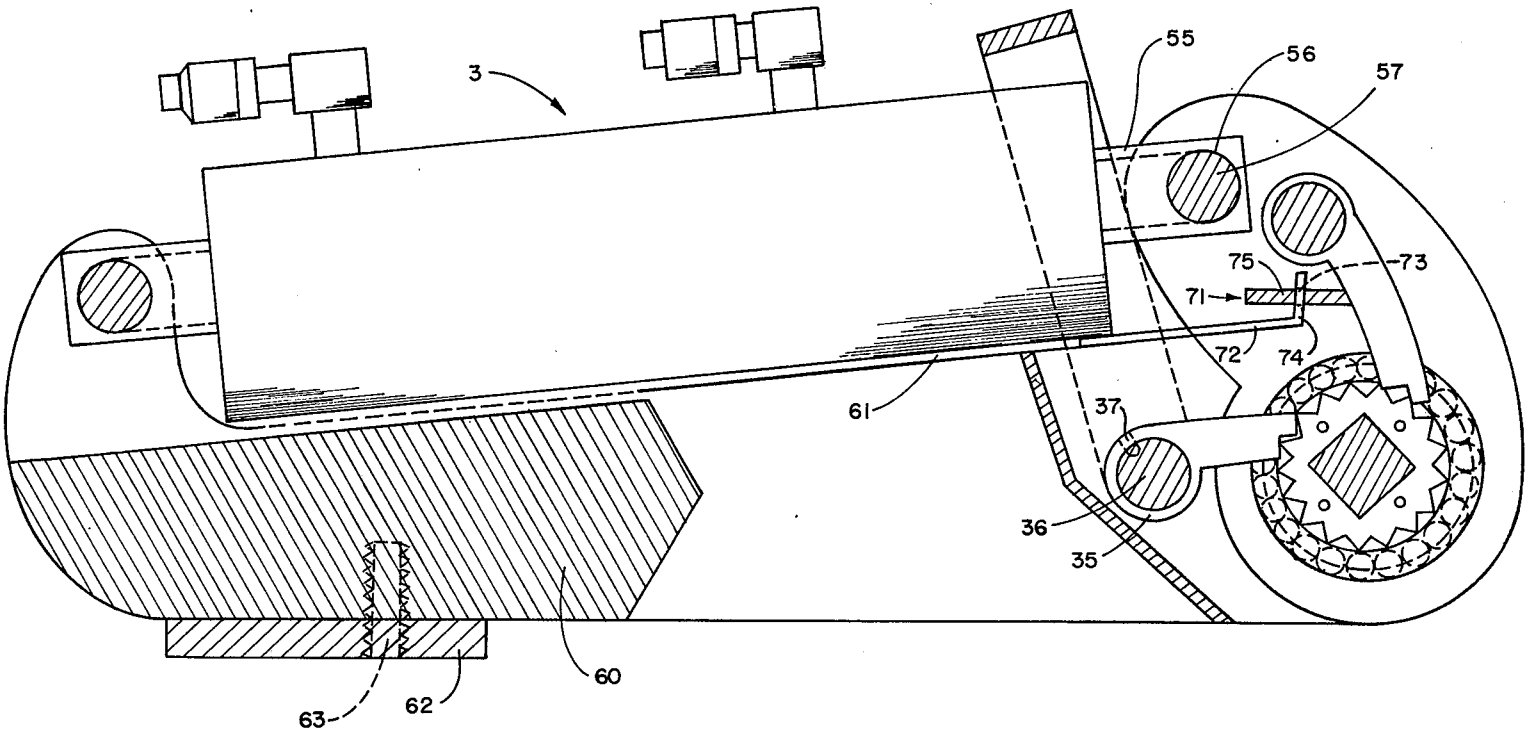
FIG. 6 is a cutaway view of an alternate embodiment of the pawl lift assembly.

It is preferred that drive pawl lift pin assembly 71 shown in FIG. 6 be replaced by driver pawl flutter lift assembly 90 (See FIG. 5) comprising a flutter lift 91 having extending shaft sections 92 and 93 that are rotatably engaged in drive plate openings 94 and 95. The arc which flutter lift 91 can move is restricted by flutter lift bars 96 and 97 extending through drive plate slot openings 98 and 99, respectively. Openings 98 and 99 are shaped to allow flutter lift 91 to strike drive pawl extension arm 31 and lift it a distance sufficient to clear rachet gear teeth 5. Openings 98 and 99 are also shaped to prevent flutter lift 91 from extending down into rachet gear teeth 5 when it is not pushing against extension arm 31.

In a preferred embodiment flutter lift 91 is activated by gear locking pawl 35. When locking pawl lift handle 42 is pushed to engage locking pawl arm 35A into ratchet gear teeth 5, it strikes flutter lift 91 forcing flutter lift 91 upward. In this position drive pawl 29 and rachet gear teeth 5 are disengaged and piston rod 55 can retract.

Figure 2:
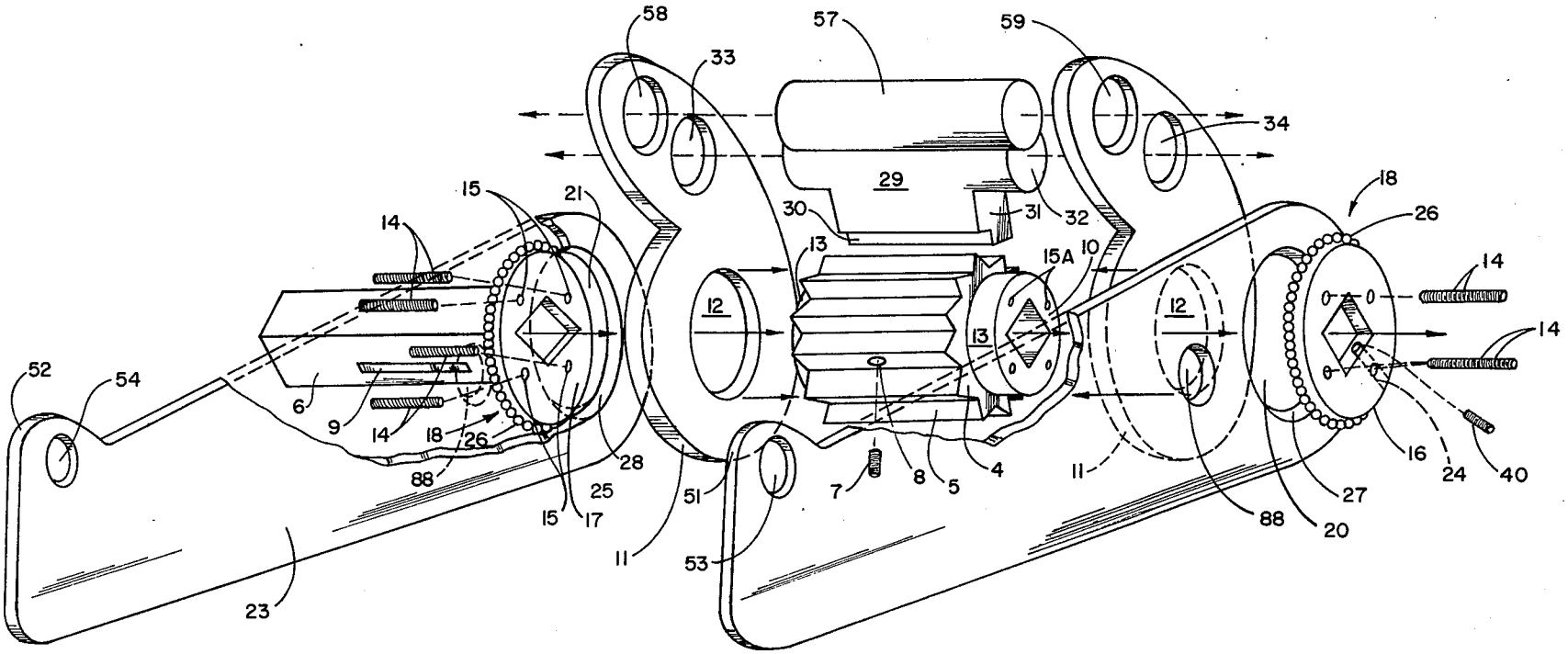
FIG. 2 is an exploded three dimensional view of the ratcheting gear assembly illustrating the body plate bushings.

Hydraulic cylinder 3 is pivotly attached at cylinder end bar 49 to cylinder reaction cross pin 50, which, in turn, is pivotly attached to body plate extensions 51 and 52, each provided with openings 53 and 54, respectively, for receiving the opposite ends of cylinder cross pin 50, as shown in the Figure. The other end of cylinder 3 is provided with piston rod 55, having openings 56 through which a second cylinder reaction cross pin 57 passes and pivotly attaches to drive plates 11 through aligned openings 58 and 59, as is seen in the FIG. 2.

In a preferred embodiment, reinforcement metal block 60 is welded between body plates 22 and 23 as shown. In addition to block 60, mid-rib dividers 61 are also welded between body plates 22 and 23 to add additional strength to the hydraulic torque wrench. Reaction bar 62 is pivotly attached to block 60 by pin 63 as shown.

In still another preferred embodiment tubular pipe 80 having a slot 81 extending horizontally along the length of pipe 80 as shown in FIG. 1, is welded to body assembly plate 22. Extending through slot 81 is eyebolt 82 whose threaded shaft 83 is screwed through block 84. When eyebolt 82 is screwed completely through block 84 it will contact pipe walls 85 forcing block 84 against pipe walls 86 and 87 to hold eyebolt in rigid position. A crane or other lifting device can then attach to eyebolt 82 to allow easier handling of the torque wrench 1. By providing slot 81 the position of eyebolt 82 can be adjusted to balance the weight of torque wrench.

There are, of course, many other alternate embodiments not specifically disclosed but which are obvious from these disclosures and are intended to be included in this invention as defined by the following claims.

What I claim is:

1. A hydraulic torque wrench having a ratcheting assembly comprising a ratcheting gear having gear teeth wherein said ratcheting gear is rotatably attached to a body assembly plate, a drive pawl attached at one end to a hydraulic cylinder piston rod and drivingly engageable at its opposite end to said ratcheting gear, the improvement to which comprises a drive pawl lifting assembly pivotly attached to said body which comprises:

(a) locking pawl pivotly attached at one end to said body assembly and having drive pawl teeth at its other end shaped to engage said gear teeth in a manner to prevent their rotation, (b) means operatively attached to said locking pawl to engage and disengage said locking pawl from said gear teeth, and (c) a flutter lift assembly pivotly attached at one end to said body assembly and having its opposite end positioned between the locking pawl other end and said drive pawl so that when said locking pawl is disengaged from said gear teeth it contacts and lifts said flutter lift assembly a distance sufficient to disengage said drive pawl from said gear teeth.

2. A hydraulic torque wrench according to claim 1 wherein said flutter lift assembly comprises stop means to prevent the flutter lift assembly's opposite end from striking said gear teeth.

* * * * *